US006818280B2

(12) United States Patent
Matsumura et al.

(10) Patent No.: US 6,818,280 B2
(45) Date of Patent: Nov. 16, 2004

(54) RECTANGULAR BRILLIANT-CUT DIAMOND

(75) Inventors: Tamotsu Matsumura, Ayase (JP); Akira Itoh, Chofu (JP); Yoshinori Kawabuchi, Yokohama (JP)

(73) Assignee: Hohoemi Brains, Inc., Tokyo (JP)

( * ) Notice: Subject to any disclaimer, the term of this patent is extended or adjusted under 35 U.S.C. 154(b) by 0 days.

(21) Appl. No.: 10/681,998

(22) Filed: Oct. 9, 2003

(65) Prior Publication Data

US 2004/0086691 A1 May 6, 2004

(30) Foreign Application Priority Data

Nov. 1, 2002 (JP) ..... 2002-319265

(51) Int. Cl.[7] ..... B32B 3/00; A44C 17/00
(52) U.S. Cl. ..... 428/156; 63/32
(58) Field of Search ..... 428/7, 28, 81, 428/156, 192, 913; 63/32

(56) References Cited

U.S. PATENT DOCUMENTS

| | | | | |
|---|---|---|---|---|
| 4,020,649 A | | 5/1977 | Grossbard | |
| 4,118,950 A | * | 10/1978 | Grossbard | 63/32 |
| 4,708,001 A | | 11/1987 | Alburger | |
| 5,186,024 A | * | 2/1993 | Waters, Jr. | 63/32 |
| 5,970,744 A | | 10/1999 | Greeff | |
| 6,474,102 B1 | | 11/2002 | Buerger | |

FOREIGN PATENT DOCUMENTS

| | | |
|---|---|---|
| DE | 197 34 036 A1 | 2/1999 |
| EP | 1 181 875 A2 | 2/2002 |

OTHER PUBLICATIONS

U.S. applicatoin No. 10/350,388, filed Jan. 23, 2003.

S. S. Stevens, Jan. 13, 1961, To Honor Fechner and Repeal His Law, Science, vol. 133.

* cited by examiner

*Primary Examiner*—Donald J. Loney
(74) *Attorney, Agent, or Firm*—McGlew and Tuttle, P.C.

(57) ABSTRACT

A diamond is provided which is subjected to an improved rectangular brilliant-cut producing a facet configuration having an optimal shape for the purpose of increasing the visual-perceptible reflection ray amount. In the rectangular brilliant-cut diamond, the bezel facets at the four crown vertexes each is bent along the diagonal line parallel to the girdle, to yield the facet configuration in which the bezel facet is divided into the lower bezel facet and the upper bezel facet. The upper crown angle of an upper bezel facet can be made smaller than the crown angle of a lower bezel facet, and hence even without altering the crown height, by making the table facet slightly smaller, the tilt angles from the horizontal of the star facets and the second bezel facets, both provided with intense reflection, can be made small and the areas thereof can be made large. Thus, the reflection patterns become all alike in size in a manner preferable for the visual perception, and making the star facets and the second bezel facets have small tilt angles from the horizontal permits making the reflection extremely intense in cooperation with enlargement of the areas of the star facets and the second bezel facets.

10 Claims, 13 Drawing Sheets

RECTANGULAR BRILLIANT-CUT DIAMOND

BACKGROUND OF THE INVENTION

1. Field of the Invention

The invention relates to a rectangular brilliant-cut of a diamond provided with a new facet configuration. The rectangular brilliant-cut is sometimes referred to as the princess cut.

2. Description of the Related Art

The size of an ornamental cut diamond depends on the size of the raw stone. In particular, the crown height, pavilion depth and girdle size are determined by the size of the raw stone.

Even if the size of a diamond is the same, the brilliancy of the diamond is varied by its cut. The present inventors have introduced, for a round brilliant cut diamond, the concept of "visual-perceptible reflection rays," and on the basis thereof have invented a cut design which can increase the visual-perceptible reflection ray amount for the purpose of evaluating the brilliancy that can be perceived by an observer when a diamond is observed; and the patent application thereof has been made (Japanese Patent Application No. 2002-253011 filed Aug. 30, 2002 and its counterpart foreign Patent Applications, e.g., for the US, U.S. Ser. No. 10/350,388, filed Jan. 23, 2003).

In the previous patent application of the round brilliant cut diamond, the amount of physical reflection rays was obtained in such a manner that meshes are defined by dividing the radius of the diamond into 100 equal segments and the ray density was obtained with respect to each mesh. Since the radius of diamonds is several millimeters, a mesh area is several hundred square micrometers. The amount of light was calculated only with respect to patterns of 30 meshes or larger by considering the area perceptible by human eyes. Amounts of visual-perceptible reflection rays were defined to be the square root of values of tenths of the amount of physical reflection rays with respect to all the patterns, and the sum of the amounts of visual-perceptible reflection rays was obtained with respect to all the patterns. That is, the amount of visual-perceptible reflection rays was calculated by the following equation:

The amount of visual-perceptible reflection rays=$\Sigma\{$(the amount of physical reflection rays with respect to patterns of 30 meshes or larger in each segment)$/10\}^{1/2}$, in which $\Sigma$ is the sum of patterns in one segment.

When a diamond is observed by an observer above the table of the diamond, the light rays incident from the backside of the observer are blocked by the observer and hence do not reach the diamond. On the contrary, the light rays with large incident angles do not effectively contribute to the reflection. Accordingly, by assuming that the light rays with the incident angles of 20 to 45 degrees with respect to the normal to the table facet of the diamond (namely, the center line connecting the table facet center and the culet) are effective light rays, the intensity of the reflection derived from the above described range of incident light rays is referred to as "the effective visual-perceptible reflection ray amount," and a cut design capable of increasing the effective visual-perceptible reflection ray amount has also been investigated in the above described patent application.

In the study of the reflection rays from the diamond, the above described effective visual-perceptible reflection ray amount is effective when uniform light rays are incident from around all the surrounding portions; on the other hand, when the light is irradiated from a plane ceiling, it is necessary that the light intensity is represented by $\cos^2\theta$ where $\theta$ is the incident angle.

In the rectangular brilliant-cut, there are formed a rectangular columnar girdle between a rectangular upper cross section and a rectangular lower cross section parallel thereto, a crown above the girdle, and a pavilion below the girdle. Because a rectangular brilliant-cut with a square girdle is often used, description will be made below assuming that a square cross section is provided.

As FIG. 16 shows the top view, FIG. 17 shows the side view and FIG. 18 shows the bottom view, the conventional rectangular brilliant-cut 400 has a square truncated pyramid shape crown 420 above a rectangular columnar girdle 410 having a square cross section and a square pyramid shape pavilion 440 below the girdle 410. In these figures, the respective x, y and z axes are shown on the basis of a coordinate system having its origin at the center of a horizontal cross section bb'bb' formed with four vertexes in the underpart of the girdle 410. The center line connecting the table facet center and the culet R is taken as the z axis, and the horizontal cross section bb'bb' is taken as the xy plane. The square truncated pyramid shape crown 420 has on the surface thereof the table facet 421, four bezel facets 423, four crown girdle facets 427, four second bezel facets 429, and eight star facets 431. The table facet 421 is situated on a plane parallel to the xy plane. The table facet 421 is the top plane of the truncated pyramid shape crown 420; in which four first vertexes F,F' are respectively provided near the upper vertexes B, B' of the square girdle 410, and four second vertexes Del each is located at a point displaced outwardly from the midpoint of a line segment, connecting two neighboring first vertexes F, F' of the four first vertexes, along the line connecting the table center and the midpoint; thus, the table facet 421 is an octagon formed by connecting each of the four second vertexes Del with the adjacent pair of the four first vertexes F, F' respectively in one-to-one correspondence with the four vertexes B, B' of the girdle. A bezel facet 423 is a quadrilateral BCFD in which a pair of diagonal vertexes are the pair of a vertex B and a vertex F or the pair of a vertex B' and a vertex F' where the vertexes B and B' are the upper vertexes of the girdle 410 and the vertexes F and F' are respectively in one-to-one correspondence with the vertexes B and B'. Each crown girdle facet 427 is a trapezoid BB'CC' which is formed with a side (for example, BB') of the upper cross section of the girdle 410 and the sides BC and B'C', closest to the above described girdle edge BB', among the sides in the two bezel facets 423 each having as a vertex thereof any of the two ends B and B' of the side BB'. A second bezel facet 429 is a triangle CC'Del which is formed with the side CC', parallel to and opposite to the girdle edge BB' among the sides of the crown girdle facet 427, and a second vertex Del, opposite to the midpoint of the side BB' of the girdle facet 427, among the vertexes of the table facet 421. A star facet 431 is a triangle CFDel which is enclosed with a side FDel of the table facet 421, a side CF of a bezel facet 423 and a side CDel of the second bezel facet 429.

A square pyramid shape pavilion 440 has on the external surface thereof four pavilion main facets 441, four pavilion girdle facets 443, and a plurality of facets 447, 449 and 451 dividing a portion between a pavilion main facet 441 and the pavilion girdle facet 443. Each of the pavilion main facets 441 is a quadrilateral bLRL' in which a vertex b in the lower portion of the girdle and the lower apex (culet) R of the square pyramid shape pavilion 440 are a pair of diagonal vertexes. The straight line passing through the lower apex R of the square pyramid shape pavilion 440 and the table facet center will be referred to as the "center line" (the z axis), and the plane including the center line and dividing an edge of the square girdle at the midpoint thereof will be referred to as the "center dividing plane" (the zx or yz plane). Every pavilion facet 441 has the vertexes L and L', opposing each other, on the center dividing planes, and a pair of adjacent pavilion facets share the side LR connecting the vertex L on the center dividing plane intervening the pair of facets and the lower apex R. Every pavilion girdle facet 443 is a triangle bb'S formed with a side bb' of the lower cross section of the girdle and a point S located on the center dividing plane intersecting the side bb'. A pavilion main facet 441 (bLRL') and a pavilion girdle facet 443 (bb'S) share a vertex of the girdle. Two boundary lines bM and bN are provided between the side bL passing through the vertex b of the lower cross section of the girdle among the sides of a pavilion main facet 441 and the side bS of a pavilion girdle facet 443 passing though the same vertex b of the girdle, having their ends on the center dividing plane common to the vertex L; thus, owing to these two boundary lines, three triangles 447, 449, 451 are provided between the two facets 441 and 443, the three triangles sharing the vertex shared by these two facets 441, 443.

As for the rectangular brilliant-cut, a cut capable of enlarging the visual-perceptible reflection ray amount has been investigated. Thus, it has been found that in the rectangular brilliant-cut, once the crown height, the pavilion depth and the girdle size have been specified, the sizes of the table facet and star facets are fixed so that it is impossible to enlarge the visual-perceptible reflection ray amount through selecting an optimal crown angle. The variation of the crown height may lead to the alteration of the sizes of the table facet and star facets, but the possibility of the crown height variation is dependent on the size of the raw stone. Now, the following fact has been revealed: the reduction in size of the table facet and enlargement in size of the star facets, for the purpose of enlarging the visual-perceptible reflection ray amount, inevitably leads to the increase of the table facet height; thus, the angle formed by a second bezel facet and the table facet or the horizontal cross section (the xy plane) formed by the upper or lower four vertexes of the girdle becomes larger than the crown angle formed by a crown girdle facet present on a side of the upper cross section of the girdle and the table facet or the horizontal cross section (the xy plane) formed by the upper or lower four vertexes of the girdle so that the cut becomes impossible actually.

SUMMARY OF THE INVENTION

Thus, an object of the invention is to provide a rectangular brilliant-cut diamond improved so as to be provided with a facet configuration capable of having an optimal shape for the purpose of enlarging the visual-perceptible reflection ray amount.

Additionally, another object of the invention is to provide a cut design based on the above described facet configuration and optimal for the purpose of enlarging the visual-perceptible reflection ray amount.

According to the invention, an improved rectangular brilliant-cut diamond comprises a rectangular columnar girdle, a crown having an octagonal table facet on a top of the crown and formed above the girdle and a pavilion below the girdle. The rectangular columnar girdle has an upper rectangular cross section parallel to the table facet at a boundary between the girdle and the crown. The crown comprises four trapezoidal crown girdle facets or upper girdle facets, four lower triangular bezel facets, four upper triangular bezel facets, four second triangular bezel facets and eight triangular star facets on an outer surrounding surface of the crown. The table facet has four first vertexes and four second vertexes, each of the four first vertexes being located adjacent to each of four vertexes of the upper cross section of the girdle and each of the four second vertexes being at a point displaced in a direction opposite to a line (hereinafter referred to as "center line") vertical to the table facet from a center point between the two neighboring first vertexes. The four crown girdle facets and the four lower bezel facets are aligned alternately to form a row along and above the boundary. Each of the four crown girdle facets has a base coinciding with a side of the upper cross section of the girdle and each of the lower bezel facets has a vertex, two sides passing the vertex and a base opposite to the vertex, the vertex coinciding with each of the vertexes of the upper cross section of the girdle and jointly owned by two crown girdle facets on both sides of each of the lower bezel facets, the two sides each coinciding with a side of each of the two crown girdle facets and the base having two ends each coinciding with a vertex owned by each of the two crown girdle facets. The four upper bezel facets, the four second bezel facets and the eight star facets are aligned to form another row between the table facet and the row having the crown girdle facets and the lower bezel facets. Each of the upper bezel facets has a vertex coinciding with one of the first vertexes of the table facet and a base coinciding with the base of the lower bezel facets. Each of the lower bezel facets has an angle with the table facet larger than an angle between each of the upper bezel facets and the table facet.

The pavilion comprises four rectangular pavilion main facets and a plurality of triangular pavilion girdle facets or lower girdle facets on an outer surrounding surface of the pavilion. Each of the pavilion main facets has two opposite vertexes, one of which is a lower apex of the diamond on the center line and the other of which coincides with each of lower vertexes of the girdle, and two sides each coinciding with a side owned by a neighboring pavilion main facet on a plane (hereinafter referred to as "center dividing plane") passing both the center line and a center between two neighboring lower vertexes of the girdle.

In the improved rectangular brilliant-cut diamond of the invention, the pavilion may comprise four triangular pavilion girdle facets. Each of the pavilion girdle facets has a base coinciding with a connecting line between the two neighboring lower vertexes of the girdle and a vertex opposite to the base on the center dividing plane crossing the base. One of the pavilion main facets and a pavilion girdle facet adjacent to the pavilion main facet jointly own a vertex coinciding with one of the lower vertexes of the girdle, the pavilion main facet has a side passing the co-owned vertex and an end on the same center dividing plane, and the pavilion girdle facet adjacent to the pavilion main facet has a side passing the co-owned vertex and another end on the same center dividing plane. Between the side of the pavilion main facet and the side of the pavilion girdle facet adjacent to the pavilion main facet, the pavilion has at least two triangular facets, owning the co-owned vertex, divided into by at least one neighboring boundary line passing the co-owned vertex and an end on the same center dividing plane. Between the side of the pavilion main facet and the side of the pavilion girdle facet, the pavilion may have one to four boundary lines, by which there are two to five triangular facets divided into.

In the improved rectangular brilliant-cut diamond of the invention, the pavilion may comprise eight triangular pavilion girdle facets. Each of the pavilion girdle facets has a vertex on a crossing line between a girdle side facet and a center dividing plane crossing the girdle side facet, another vertex coinciding with a lower vertex of the girdle side facet, and a separated vertex on the center dividing plane. Each of the pavilion girdle facets has a side co-owned on the center dividing plane with a neighboring pavilion girdle facet that has a vertex coinciding with another lower vertex of the same girdle side facet. The two neighboring pavilion girdle facets have such an angle between them that the co-owned side on the center dividing plane forms a ridge between them. One of the pavilion main facets and a pavilion girdle facet adjacent to the pavilion main facet jointly own a vertex coinciding with one of the lower vertexes of the girdle. The pavilion main facet has a side passing the co-owned vertex and an end on the same center dividing plane, and the pavilion girdle facet adjacent to the pavilion main facet has a side passing the co-owned vertex and another end on the same center dividing plane. Between the side of the pavilion main facet and the side of the pavilion girdle facet adjacent to the pavilion main facet, the pavilion has at least two triangular facets, owning the co-owned vertex, divided into by at least one neighboring boundary line passing the co-owned vertex and further another end on the same center dividing plane. Between the side of the pavilion main facet and the side of the pavilion girdle facet, the pavilion may have one to four boundary lines, by which there are two to five triangular facets divided into.

In the improved rectangular brilliant-cut diamond of the invention, it is preferable that the pavilion has one boundary line passing the co-owned vertex of the girdle and the other end on the same center dividing plane to have two triangular facets, owning the co-owned vertex, divided into by the neighboring boundary line between the side of the pavilion main facet and the side of the pavilion girdle facet adjacent to the pavilion main facet.

In the improved rectangular brilliant-cut diamond of the invention, it is preferable that the angle between the lower bezel facet and the table facet is 23 to 26 degrees, that the angle between the upper bezel facet and the table facet is smaller than the angle between the lower bezel facet and the table facet and 13 to 25 degrees, and that the pavilion main facet is at an angle of 38 to 42 degrees with the table facet.

In the improved rectangular brilliant-cut diamond of the invention, assuming that the center line stands at the origin (0, 0) of x, y-coordinates and that one of the girdle lower vertexes is at (2, 2) of the x, y-coordinates, it is preferable that the first vertex, adjacent to the girdle lower vertex, of the table facet is at (0.7 to 1.2, 0.7 to 1.2) of the x, y-coordinates, that the three lines closest to the center line among the side of the pavilion main facet, the side of the pavilion girdle facet, and the boundary lines between the side of the pavilion main facet and the side of the pavilion girdle facet adjacent to the pavilion main facet cross the center dividing plane at points closer to the origin than x-coordinate of the first vertex of the table facet, and that the second vertex of the table facet is at x-coordinate of 1.3 to 1.6.

DETAILED DESCRIPTION OF THE PREFERRED EMBODIMENTS

Figure 1:
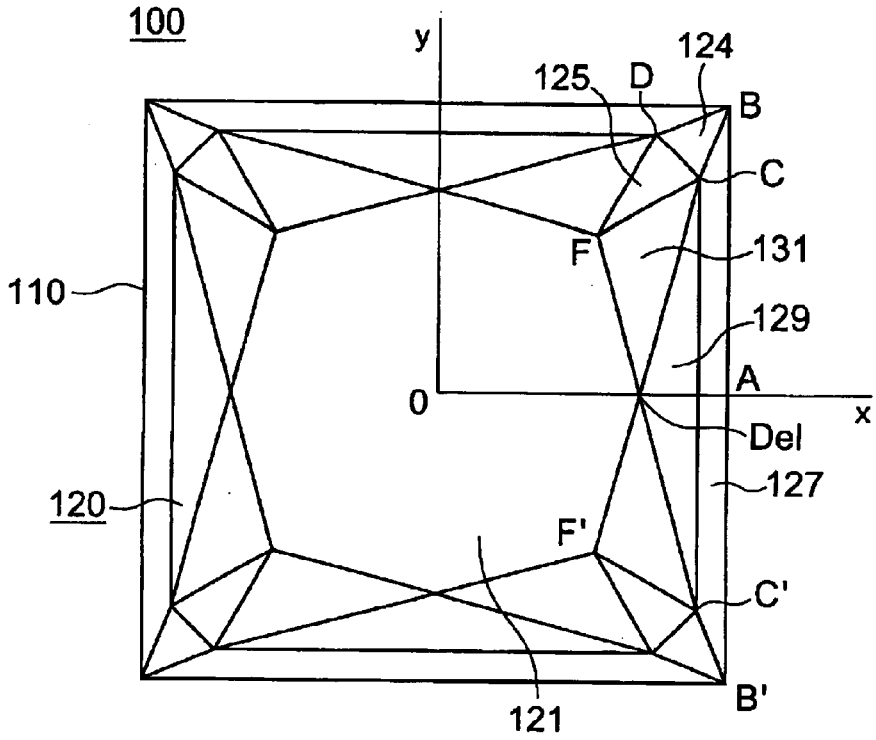
FIG. 1 shows a top view of the improved rectangular brilliant-cut diamond of EXAMPLE 1 according to the invention.
Figure 2:
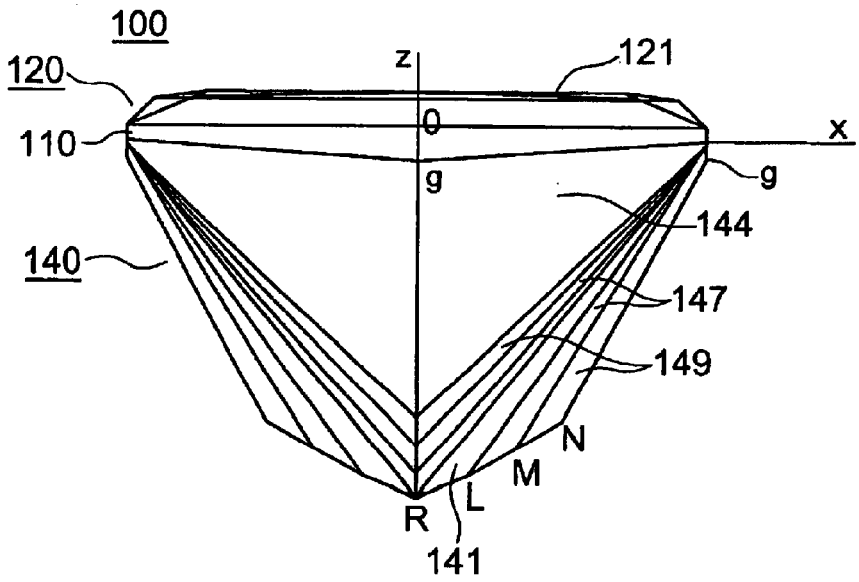
FIG. 2 shows a side view of the improved rectangular brilliant-cut diamond of EXAMPLE 1 according to the invention.
Figure 3:
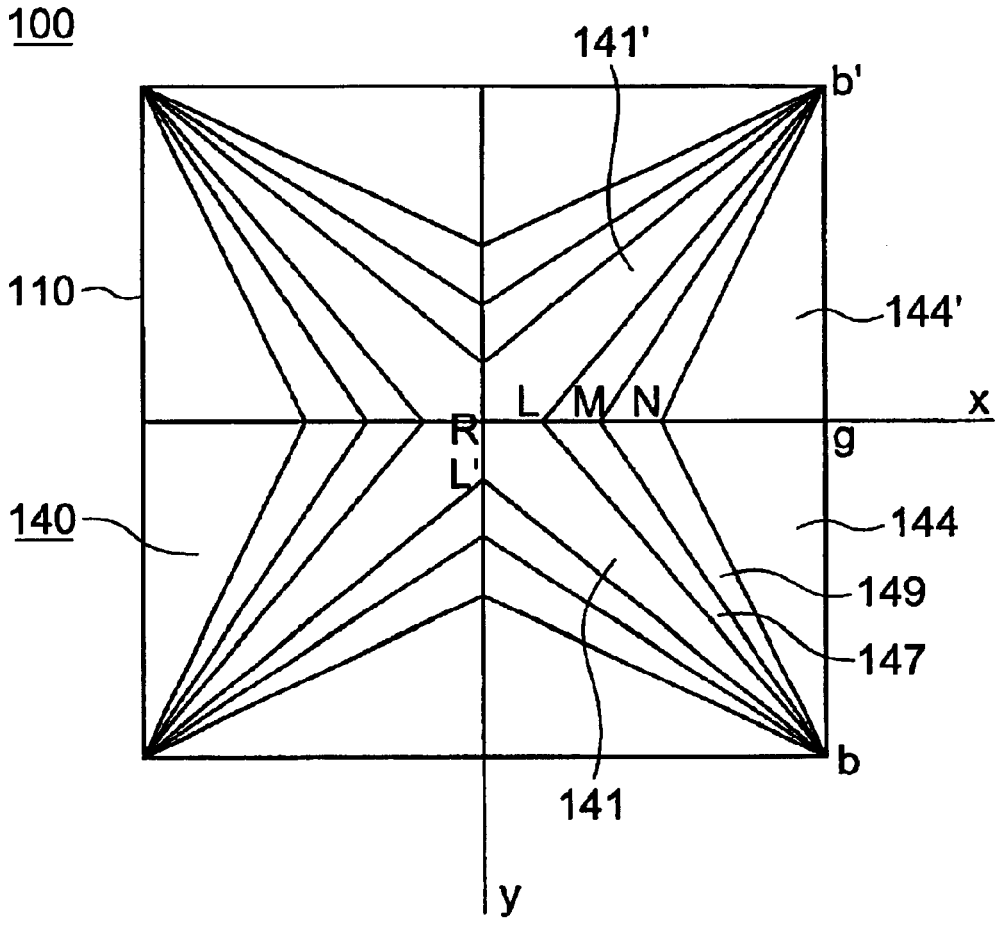
FIG. 3 shows a bottom view of the improved rectangular brilliant-cut diamond of EXAMPLE 1 according to the invention.

FIGS. 1 to 3 show the improved rectangular brilliant-cut of EXAMPLE 1 according to the invention. FIG. 1 shows a top view, FIG. 2 a side view and FIG. 3 a bottom view of the cut concerned. In these figures, the respective x, y and z axes are shown as the coordinates having the origin thereof at the center of the horizontal cross section formed by the four lower vertexes of the girdle. The center line connecting the table facet center and the culet R is taken as the z axis, and the horizontal cross section formed by the lower four vertexes of the girdle is taken as the xy plane. Even the improved rectangular brilliant-cut 100 comprises a rectangular columnar girdle 110 interposed between a rectangular upper cross section and a rectangular lower cross section parallel thereto, a rectangular truncated pyramid shape crown 120 above the girdle 110 and a pavilion 140 below the girdle 110. In the following description, for the convenience of description, description will be made by assuming that the upper and the lower cross sections of the rectangular girdle each is a rectangle, preferably a square.

The square truncated pyramid shape crown 120 has on the surface thereof a table facet 121, four crown girdle facets 127, four lower bezel facets 124, four upper bezel facets 127, four second bezel facets 129 and eight star facets 131. The table facet 121 located on a plane parallel to the xy plane is the top face of the truncated square pyramid shape crown 120, is provided with four first vertexes F, F' respectively in one-to-one correspondence with the four upper vertexes B, B' of a square columnar girdle 110, and is an octagon formed by the four second vertexes Del located at a position displaced outward (in a direction away from the center line along the line connecting the table center and the midpoint of the line segment FF') from the midpoint of a line segment connecting a pair of adjacent first vertexes (for example, F and F') among the four first vertexes and the four first vertexes F, F' respectively in one-to-one correspondence with the four vertexes B, B' of the girdle 110. In the conventional rectangular brilliant-cut 400 shown in FIG. 16, each of the bezel facets 423 is a quadrilateral BCDF which has as a pair of the diagonal vertexes B and F or B' and F' where the vertexes B and B' are the vertexes of the upper cross section of the girdle and the vertexes F and F' are the vertexes of the table facet 421 respectively in one-to-one correspondence with the above described vertexes B and B'; however, in the invention shown in FIG. 1, bending is made along the diagonal line CD, and the triangle BCD makes a lower bezel facet 124 and the triangle FCD makes an upper bezel facet 125. Every crown girdle facet 127 is a trapezoid formed by a side (for example, BB') of the upper cross section of the girdle 110 and the sides BC and B'C' closest to the above described side BB' among the sides of the two lower bezel facets 124 each having as its vertex either of the ends B and B' of the side BB'. The four crown girdle facets 127 and the four lower bezel facets 124 are alternately and horizontally arranged along the periphery of the upper cross section of the girdle to form a row. A second bezel facet 129 is a triangle CC'Del formed by the side CC' parallel to and opposite to the edge BB' of the girdle among the sides of a crown girdle facet 127 and a second vertex Del opposite to the midpoint of the side CC' of the girdle facet among the vertexes of the table facet 121. A star facet 131 is a triangle CFDel which is enclosed with a side FDel of the table facet 121, a side CF of an upper bezel facet 125 and a side CDel of a second bezel facet 129. The four upper bezel facets 129, the four second bezel facets 129 and the eight star facets 131 are horizontally arranged between the table facet and the lower sequence to form a row.

The square pyramid pavilion 140 has on the surrounding surface thereof four pavilion main facet 141, eight pavilion girdle facets 144, 144', and a plurality of facets 147, 149 formed by dividing the surface region between the pavilion main facet 141 and the neighboring pavilion girdle facets 144, 144'. The pavilion main facet 141 is a quadrilateral bLRL' in which a vertex b of the square girdle 110 and the lower apex (culet) R of the square pyramid shape pavilion make a pair of diagonal vertexes. Incidentally, the lower apex R lies on the center line (the z axis). The pavilion main facet 141 has the vertexes L, L', on the different sides thereof, respectively situated on a center dividing plane, namely, the zx plane or another center dividing plane, namely, the yz plane; a pair of adjacent pavilion main facets jointly own the side LR connecting the vertex L, situated on the center dividing plane intervening between the pair of adjacent pavilion main facets, and the lower apex R. The pavilion girdle facets 144, 144' are respectively the triangles gbN, gbN' which are formed by a point g on the intersection line between a side facet of the girdle 110 and a center dividing plane intersecting therewith, the lower vertex b or b' of the girdle, and another point N situated on the center dividing plane. A pavilion main facet 141 (bLRL') and a pavilion girdle facet 144 (gbN) co-own a lower vertex b of the girdle, and a pavilion main facet 141' and a pavilion girdle facet 144' (gb'N) co-own a lower vertex b' of the girdle. In the rectangular brilliant-cut 400 shown in FIG. 18, a pavilion girdle facet 443 is a triangle Sbb' in which a side is a lower edge bb' of the girdle; however, in the rectangular brilliant-cut 100 shown in FIG. 3, the pavilion girdle facets 144, 144' are the triangles which jointly own the side gN situated on a center dividing plane and are slightly inclined from each other with a small inclining angle around the side gN. The intersection of either of the two pavilion girdle facets 144, 144' is made to have an x coordinate of the order of 2.2 (by assuming the coordinates of the point B as (2,2)). There is a boundary line bM between the side bL passing through a vertex b of the girdle 110 among the sides of a pavilion main facets 141 and the side bN of a pavilion girdle facet 144 passing through the same vertex b of the girdle 110 and having an end N on a center dividing plane (for example, the zx plane); the boundary line bM passes through the same girdle vertex b, and has an end M on the same center dividing plane; with the boundary line bM, between the two facets 141, 144 are formed two triangles 147 and 149 sharing the vertex jointly owned by the two facets 141, 144.

Figure 16:
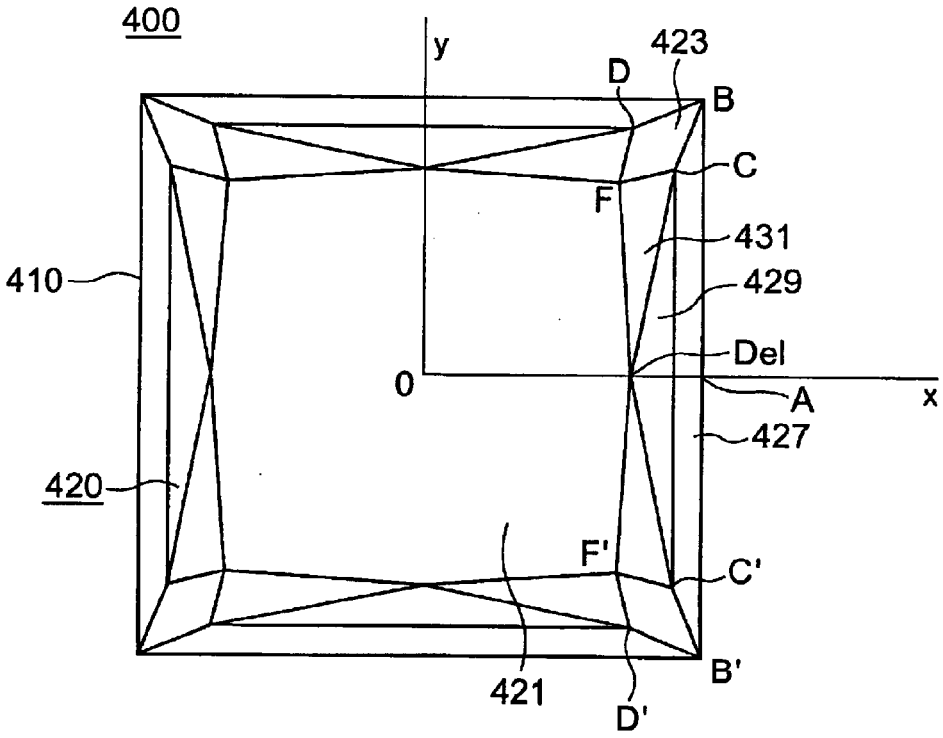
FIG. 16 shows a top view of a conventional rectangular brilliant-cut.
Figure 17:
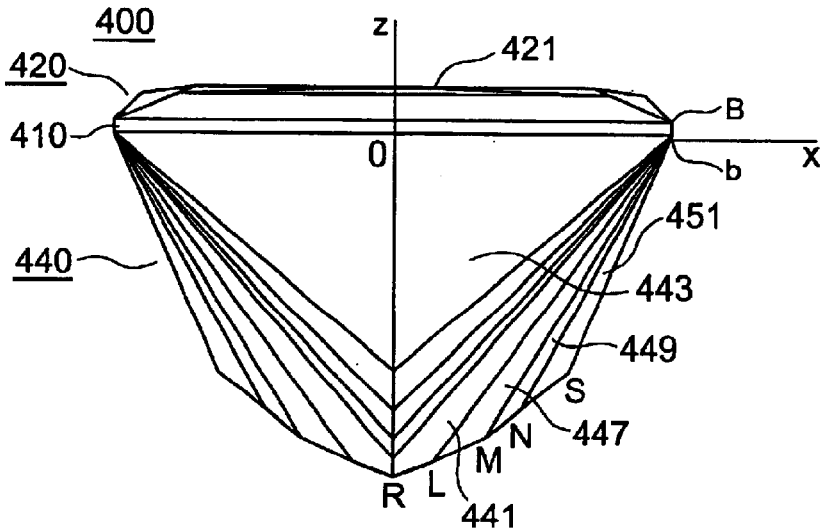
FIG. 17 shows a side view of the conventional rectangular brilliant-cut.
Figure 18:
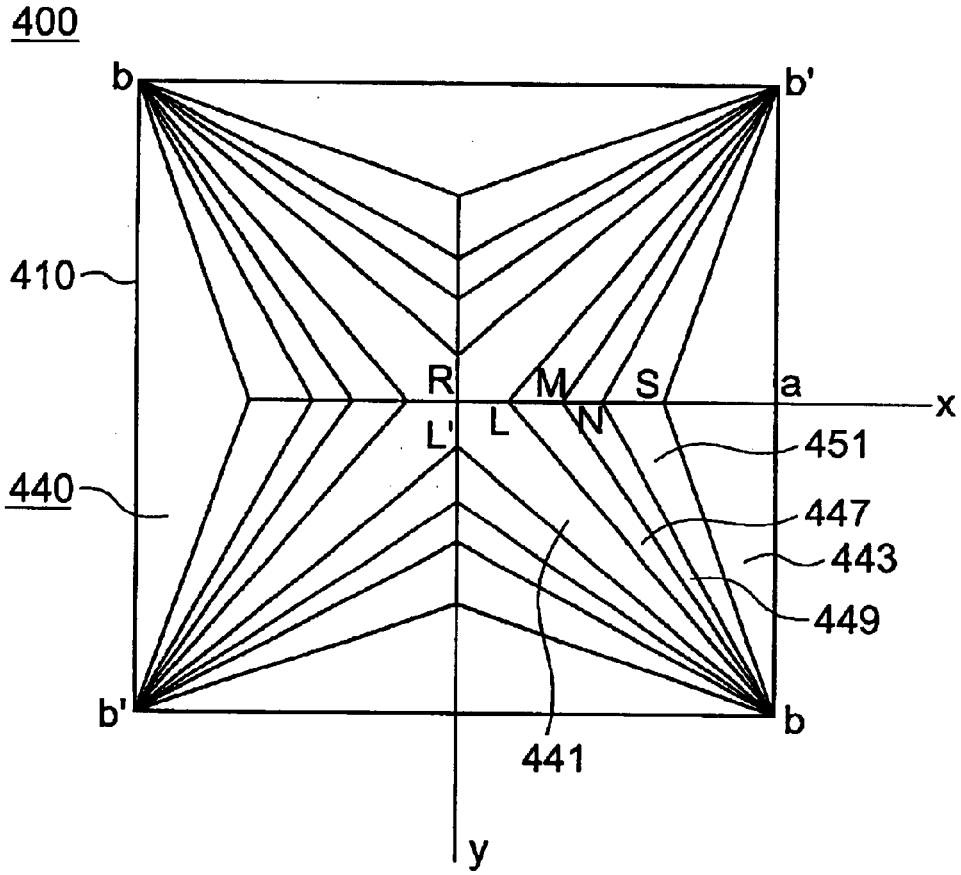
FIG. 18 shows a bottom view of the conventional rectangular brilliant-cut.

As can be seen clearly from a comparison of the above description on the improved rectangular brilliant-cut 100 according to the invention shown in FIGS. 1 to 3 with the description previously made on the conventional rectangular brilliant-cut 400 shown in FIGS. 16 to 18, in the improved rectangular brilliant-cut 100 according to the invention, a bezel facet BCFD is bent along the diagonal line CD, thus being divided into a lower bezel facet 124 and an upper bezel facet 125. The angle formed by a lower bezel facet 124 and the table facet 121, as viewed on an x=y plane passing though the vertex B of the girdle 110, will be referred to as the "crown angle" at B. The angle formed by the related upper bezel facet 125 and the table facet 121, as viewed on the same x=y plane, will be referred to as the "upper crown angle." In the improved rectangular brilliant-cut according to the invention, the preferable range of the crown angle at B is from 23 to 26°, and the preferable range of the upper crown angle at B is 13 to 25°; and the upper crown angle at B is smaller than the crown angle at B. Because the upper crown angle at B can be made smaller, even when the crown height (the table facet height as measured from the girdle plane) is kept the same, the first vertexes F of the table facet 121 each can be provided at a position closer to the center line (the z axis). With the coordinate axes arranged as shown in FIG. 1, taking the coordinates of B as (2, 2), the x and y coordinates of a first vertex F of the table facet 121 can be taken as (0.7 to 1.2, 0.7 to 1.2). Accordingly, the area of a star facet 131 and the area of a second bezel facet 129 can be enlarged. Additionally, even when a first vertex F is arranged at such a position closer to the center line, the angle formed by a second bezel facet 129 and the xy plane as view on the zx plane can be made smaller than the crown angle at the point A formed by a crown girdle facet 127 and the xy plane (this plane is parallel to the table facet) as viewed on the zx plane, and hence the intersection line between the crown girdle facet 127 and the second crown girdle facet 129 can be made to protrude, thus making it possible to cut.

When the light rays incident on a rectangular brilliant-cut diamond through the facets in the crown, reflected in the diamond and exiting from the facets in the crown are observed on the z axis, it can be seen that the light ray amount incident on the neighborhood of the F vertexes of the table facet, bezel facets and second bezel facets and exiting from the neighborhood of the diagonal lines of the table facet and from the bezel facets are prominent, and the light ray amounts exiting from the star facets and the central portion of every crown girdle facet take the second place. The intensity of the light exiting from the bezel facets is intense, but the relevant areas are small. The table facet is large in area, the sizes of the patterns thereof are all alike, and the reflection intensity therefrom is high. The brilliancy of the star facets and the brilliancy of the second bezel facets are extremely weak in the conventional rectangular brilliant-cut, but in the improved rectangular brilliant-cut according to the invention, the reflection patterns appearing on the star facets, second bezel facets and table facet become all alike in a manner preferable to visual perception, and the relevant brilliancy becomes intense. Additionally, the areas of the star facets and second bezel facets become large which is extremely effective in enhancing the brilliance of the reflection.

Figure 4:
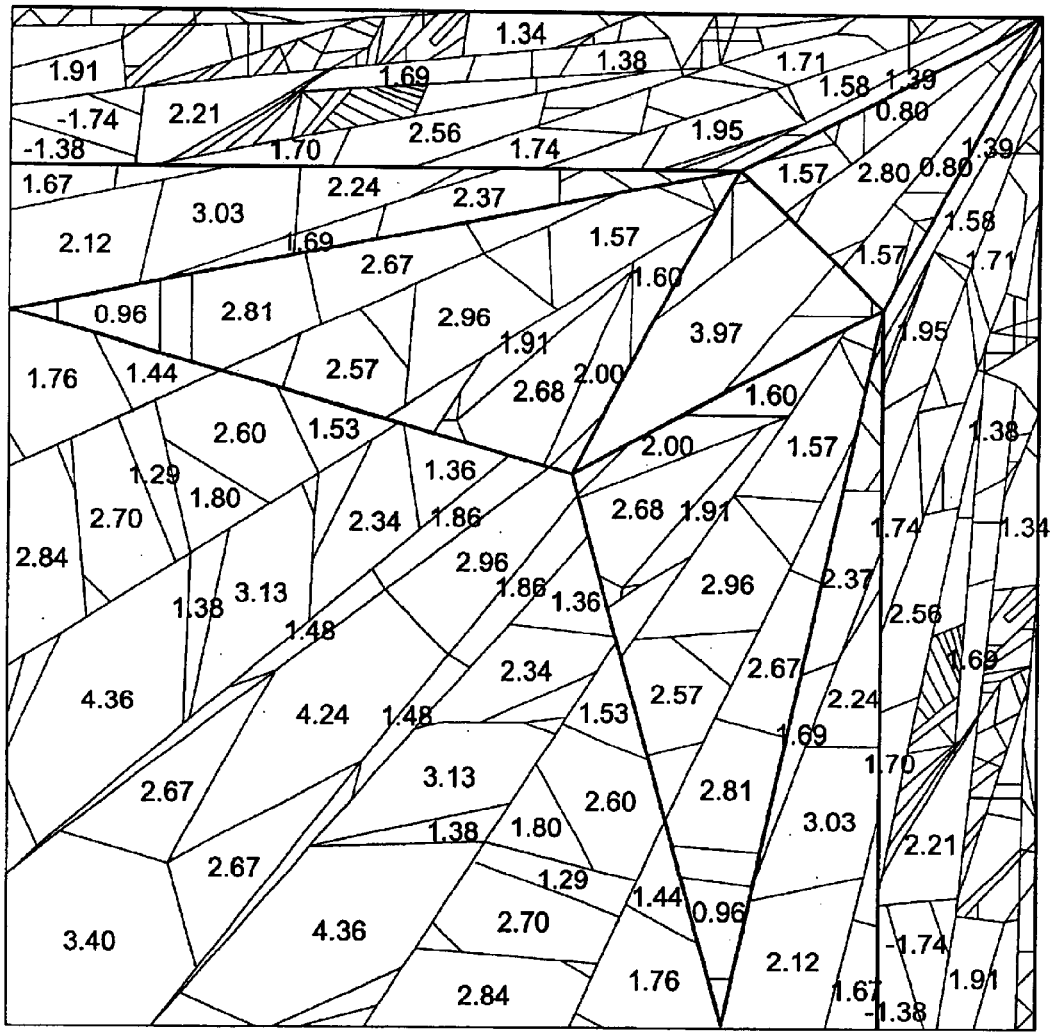
FIG. 4 is a diagram illustrating the first quadrant of the reflection patterns by the improved rectangular brilliant-cut diamond of EXAMPLE 1 according to the invention.
Figure 19:
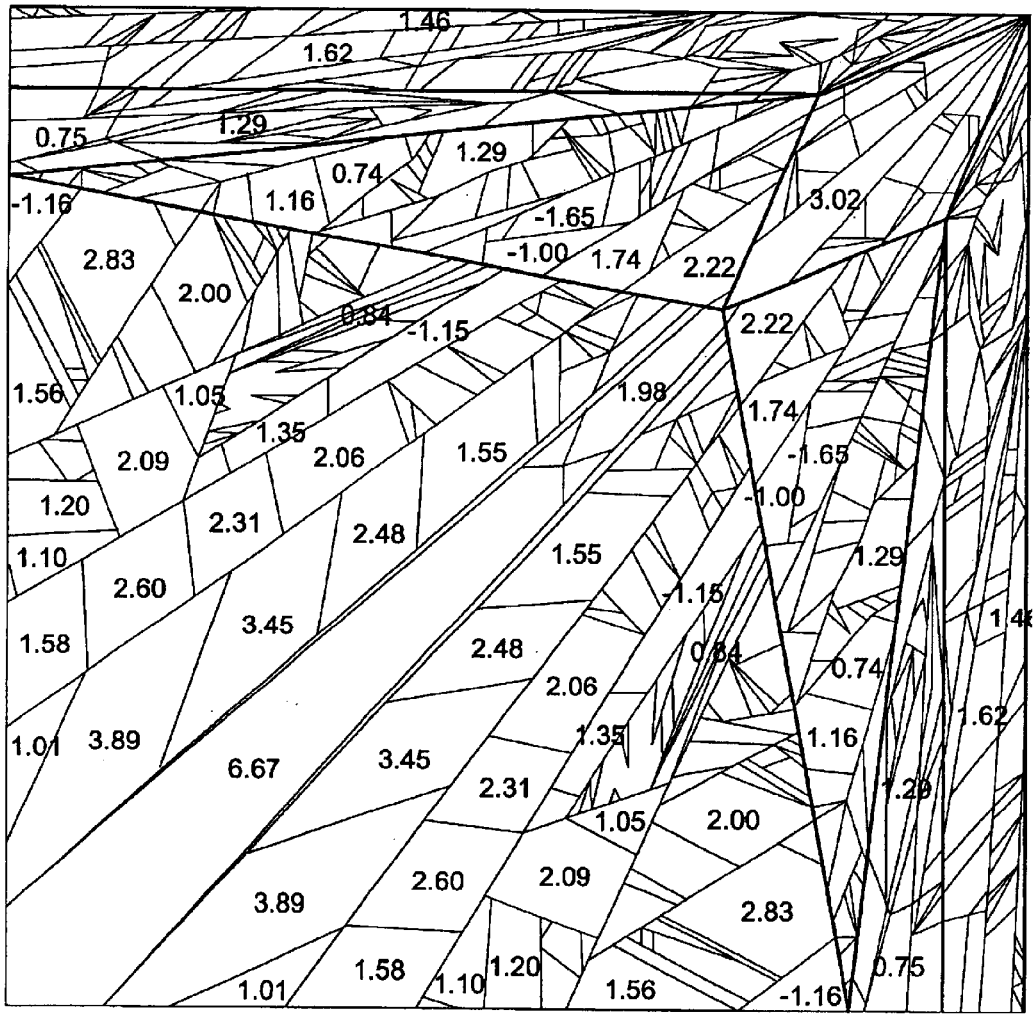
FIG. 19 is a diagram illustrating the first quadrant of the reflection patterns by the conventional rectangular brilliant-cut.

FIG. 4 shows the reflection patterns of a diamond subjected to the improved rectangular brilliant-cut 100 according to the invention, and for comparison, FIG. 19 shows the refection patterns of a diamond subjected to the conventional rectangular brilliant-cut 400. These figures respectively show the first quadrants, between the x and y axes, of the crown parts of the diamonds shown in FIGS. 1 and 16. The facet boundaries are indicated with thick solid line, and the pattern boundaries are indicated with thin lines. The numerals written in the patterns indicate the effective visual-perceptible reflection ray amounts of the patterns, respectively. The patterns with the minus signs (–) in front of the numerals are the patterns formed on the crown by the light rays incident on the backsides. Additionally, only the boundaries are shown for the minute patterns.

As can be seen from the comparison of the patterns in FIGS. 4 and 19, the reflection patterns all more alike in size for visual perception are observed on the star facets, second bezel facets and table facet in the diamond 100 subjected to the improved rectangular brilliant-cut of the invention than in the diamond 400 subjected to the conventional rectangular brilliant-cut. On the contrary, in the conventional rectangular brilliant-cut 400, the patterns of the star facets and second bezel facets are fine, and the light rays from the backsides appear as patterns to higher extent. As described above, the backside light patterns appear to higher extents in the conventional rectangular brilliant-cut so that the brilliancy of a diamond is further degraded when the diamond is fixed to a mounting.

The feature values and the total amounts of the reflection for the improved rectangular brilliant-cut shape adopted here of the invention and a conventional rectangular brilliant-cut shape are collected in Table 1. In Table 1, CB denotes the crown angle (degrees) at B, UCB denotes the upper crown angle at B (degrees), PB denotes the pavilion angle (degrees) at B, CA denotes the crown angle (degrees) at A, F denotes the coordinates at the point F (x=y, hence only one value is given), Delx denotes the x coordinate at Del, C denotes the x coordinate at C, and Lx, Mx, Nx and Sx denote the x coordinates at the points L, M, N and S, respectively. The item 20-45 denotes the effective visual-perceptible reflection ray amount derived from the light rays incident with the angles from 20 to 45 degrees with respect to the z axis, the item 0-90w denotes the visual-perceptible reflection ray amount obtained from the incident rays weighted with $\cos^2\theta$ where $\theta$ is the incident angle with respect to the z axis, and the item "AVERAGE" is the arithmetic mean of these two types of visual-perceptible reflection ray amounts. As can be clearly seen from Table 1, the brilliancy of the rectangular brilliant-cut diamond of the invention is overwhelmingly stronger as compared to the conventional rectangular brilliant-cut diamond.

TABLE 1

| | IMPROVED RECTANGULAR BRILLIANT-CUT (EXAMPLE 1) | CONVENTIONAL RECTANGULAR BRILLIANT-CUT (COMPARATIVE EXAMPLE) |
|---|---|---|
| SPECIMEN | A512 | A000 |
| CB | 25 | 23 |
| UCB | 17.5 | — |
| PB | 40 | 43 |
| CA | 44 | 47 |
| F | 1.1 | 1.4 |
| Delx | 1.4 | 1.66 |
| C | 1.7 | 1.84 |
| Lx | 0.3 | 0.19 |
| Mx | 0.7 | 0.55 |
| Nx | 1.1 | 0.8 |
| Sx | — | 1.1 |
| 20–45 | 401.9 | 111.7 |
| 0–90 w | 578.9 | 245.0 |
| AVERAGE | 490.4 | 178.4 |

Figure 5:
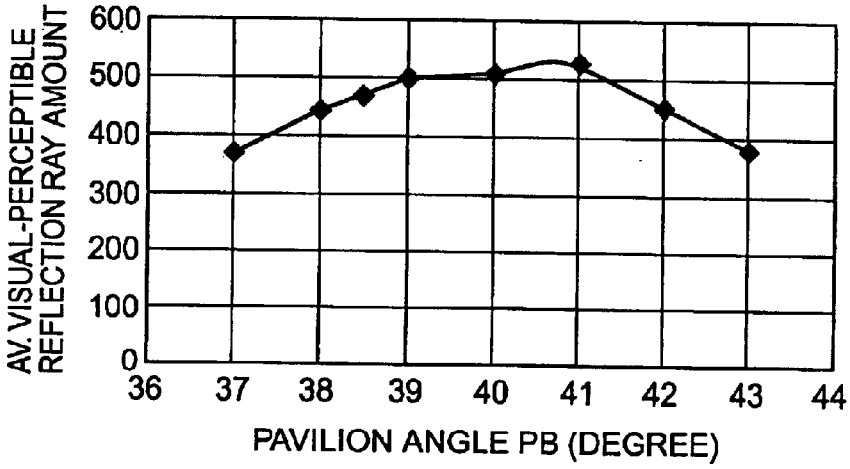
FIG. 5 is a graph showing the relationship of the average visual-perceptible reflection ray amounts vs. the pavilion angle of the improved rectangular brilliant-cut diamond of EXAMPLE 1 according to the invention.

Description is made below on the preferable values for the feature values of the shape of the improved rectangular brilliant-cut diamond of the invention. The average visual-perceptible reflection ray amount as a function of the pavilion angle PB (degrees) at the point B in the variation range from 37 to 43 degrees is, as shown in FIG. 5, 450 or more for the pavilion angles PB in the range from 38 to 42 degrees, and accordingly the preferable range of the pavilion angle PB falls in the range from 38 to 42 degrees.

Figure 6:
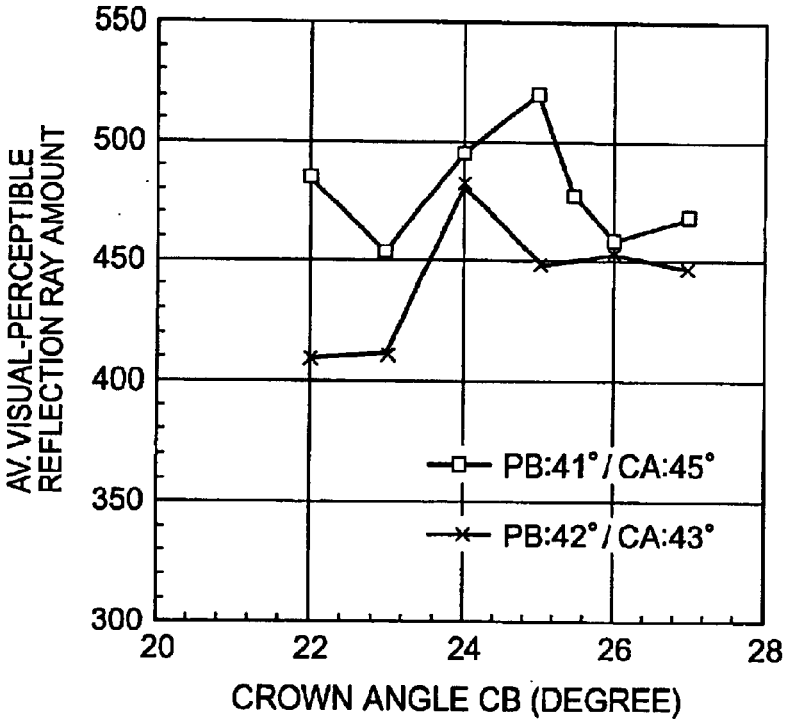
FIG. 6 is a graph showing the relationship of the average visual-perceptible reflection ray amounts vs. the crown angle of the improved rectangular brilliant-cut diamond of EXAMPLE 1 according to the invention.
Figure 7:
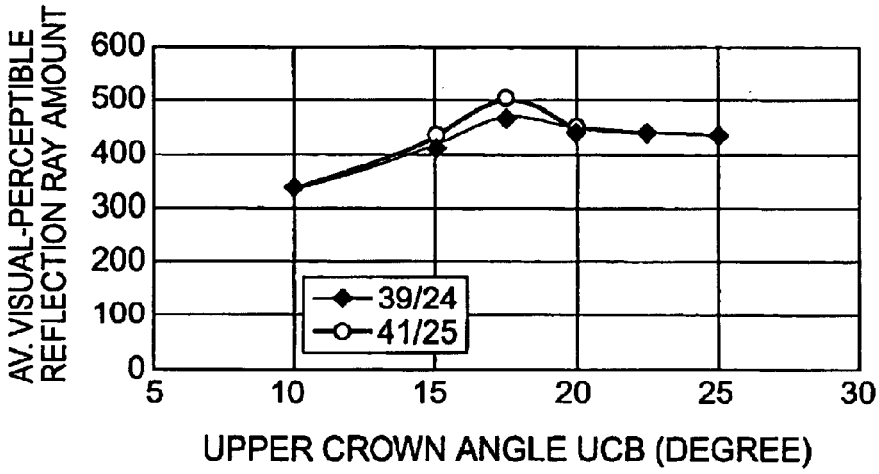
FIG. 7 is a graph showing the relationship of the average visual-perceptible reflection ray amounts vs. the upper crown angle of the improved rectangular brilliant-cut diamond of EXAMPLE 1 according to the invention.

As FIG. 6 shows, the average visual-perceptible reflection ray amount becomes large for the crown angles CB (degrees) at the point B from 23 to 26 degrees. FIG. 6 shows the average visual-perceptible reflection ray amounts as a function of the crown angle CB (degrees) in the variation range from 22 to 27 degrees at the point B for a diamond subjected to the rectangular brilliant-cut in which the pavilion angle PB at the point B is 41 degrees and the crown angle CA at the point A is 45 degrees and a diamond subjected to the rectangular brilliant-cut in which the pavilion angle PB at the point B is 42 degrees and the crown angle CA at the point A is 43 degrees. By making the crown angle fall in the preferable range from 23 to 26 degrees, the average visual-perceptible reflection ray amount becomes large and the reflection patterns come to take all alike sizes preferable for the visual perception. For the rectangular brilliant-cut with the pavilion angle 41 degrees at the point B/the crown angle 25 degrees at the point B and the rectangular brilliant-cut with the respective corresponding values 39 degrees/24 degrees, the average visual-perceptible reflection ray amounts are shown in FIG. 7 as a function of the upper crown angle UCB (degrees) in the variation range from 10 to 25 degrees; the average visual-perceptible reflection ray amounts become 400 or more for the upper crown angles falling in the range from 13 to 25 degrees. Additionally, an indispensable condition is such that the upper crown angle UCB be smaller than the crown angle CB because otherwise machining becomes impossible.

The reflection is more intense with the F value of 1.1 on the table facet than with the F value of 1.2, and furthermore, the reflection is more intense with the F value of one than with the F value of 1.1. However, when the F value becomes 0.7 or less, the crown angle of the second bezel facet may become larger than the crown angle CA at the point A so machining becomes impossible. Accordingly, the F value should be from 0.7 to 1.2. The crown angle CA (degrees) at the point A falls in the range from 43 to 47 degrees centering around from 44 to 45 degrees, with no significant relevant effect.

If the Delx value is not larger than the F value, machining is impossible; for the purpose of making the sizes of the star facet 131 and second bezel facet 129 nearly the same, the Delx value is preferably from 1.3 to 1.6.

For the purpose of reflecting the light rays to pass through the table facet 121, star facets 131 and second bezel facets 129, it is recommended that the pavilion main facets 141, and other facets 147, 149 in the pavilion are located practically just beneath the table facet 121, and preferably the Lx, Mx and Nx values are all smaller than the F value.

Figure 8:
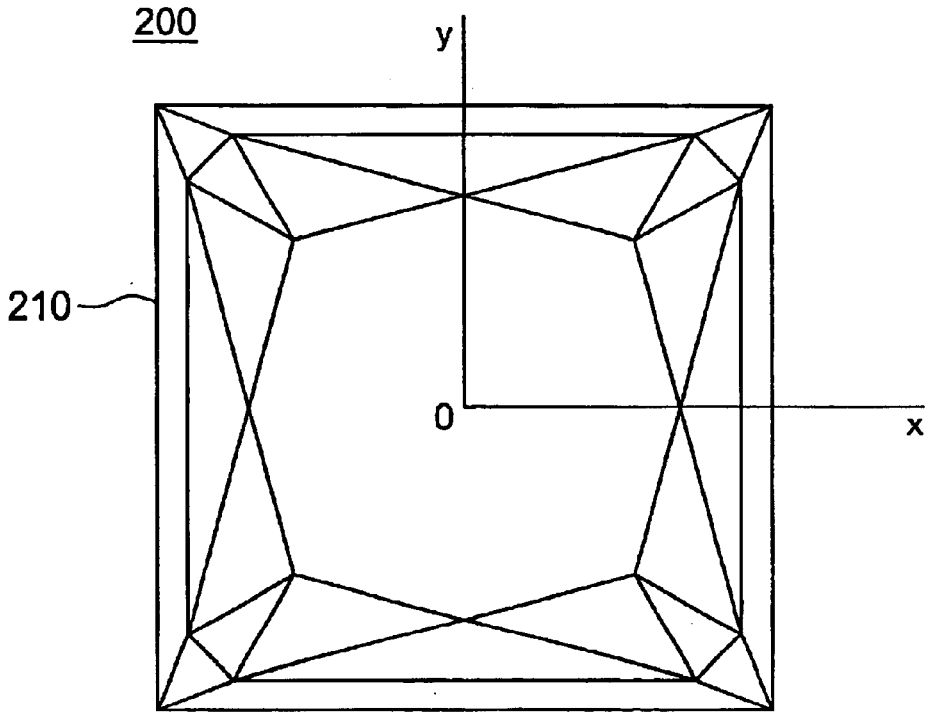
FIG. 8 shows a top view of the improved rectangular brilliant-cut diamond of EXAMPLE 2 according to the invention.
Figure 9:
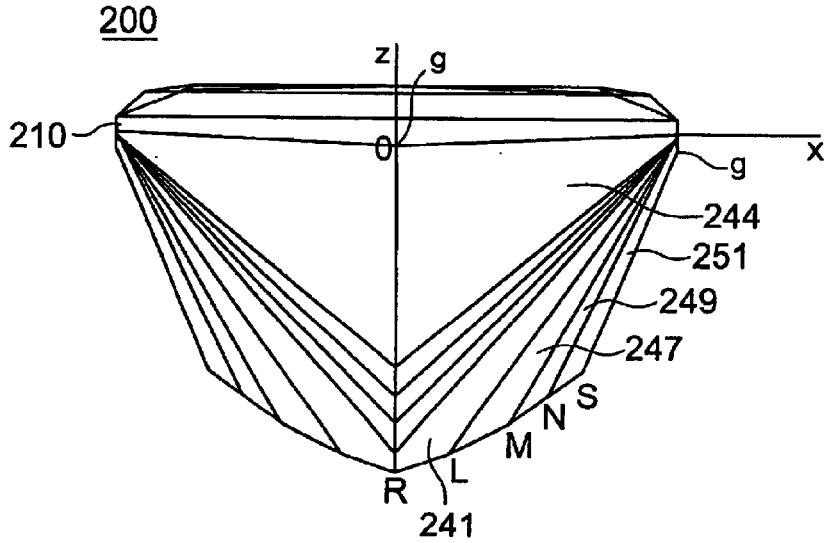
FIG. 9 shows a side view of the improved rectangular brilliant-cut diamond of EXAMPLE 2 according to the invention.
Figure 10:
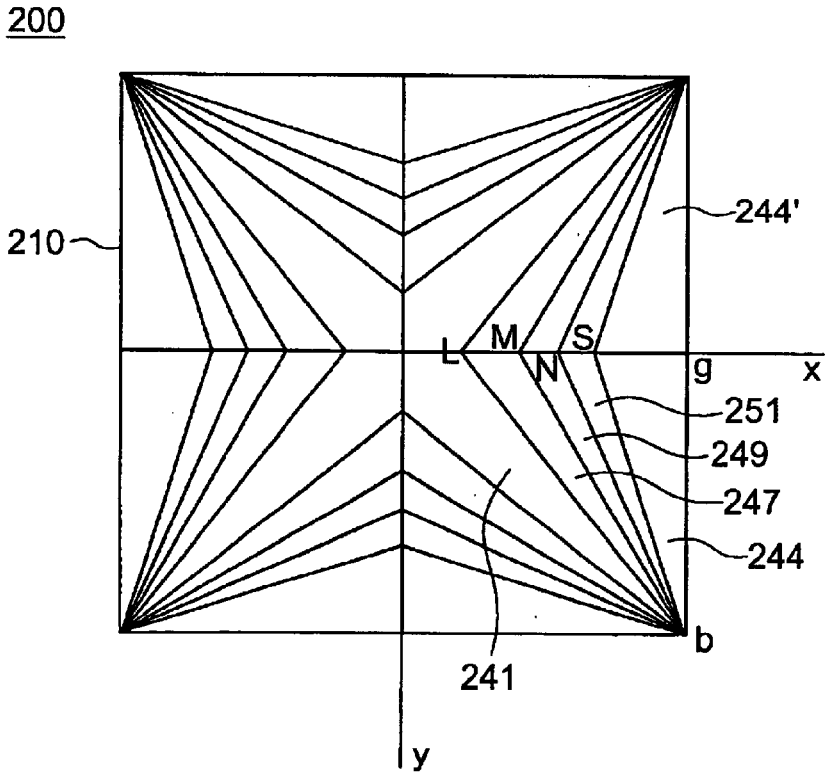
FIG. 10 shows a bottom view of the improved rectangular brilliant-cut diamond of EXAMPLE 2 according to the invention.
Figure 12:
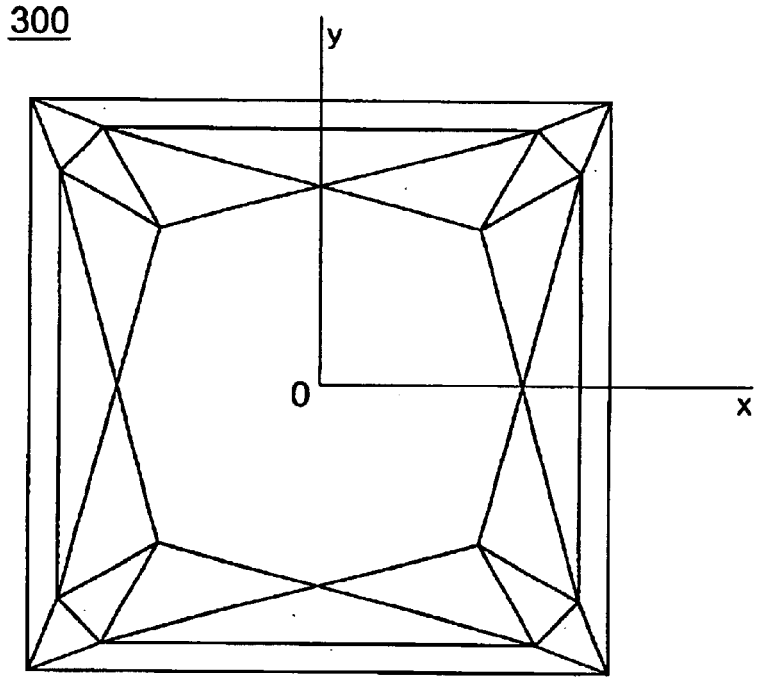
FIG. 12 shows a top view of the improved rectangular brilliant-cut diamond of EXAMPLE 3 according to the invention.
Figure 13:
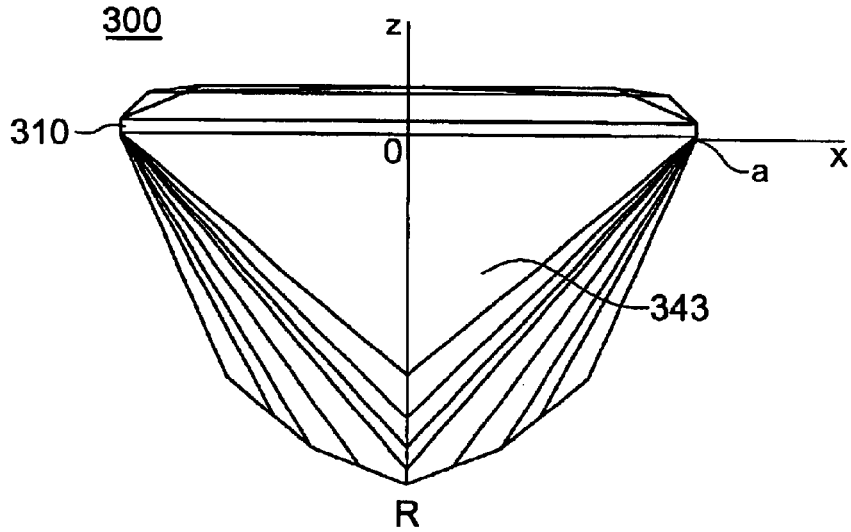
FIG. 13 shows a side view of the improved rectangular brilliant-cut diamond of EXAMPLE 3 according to the invention.
Figure 14:
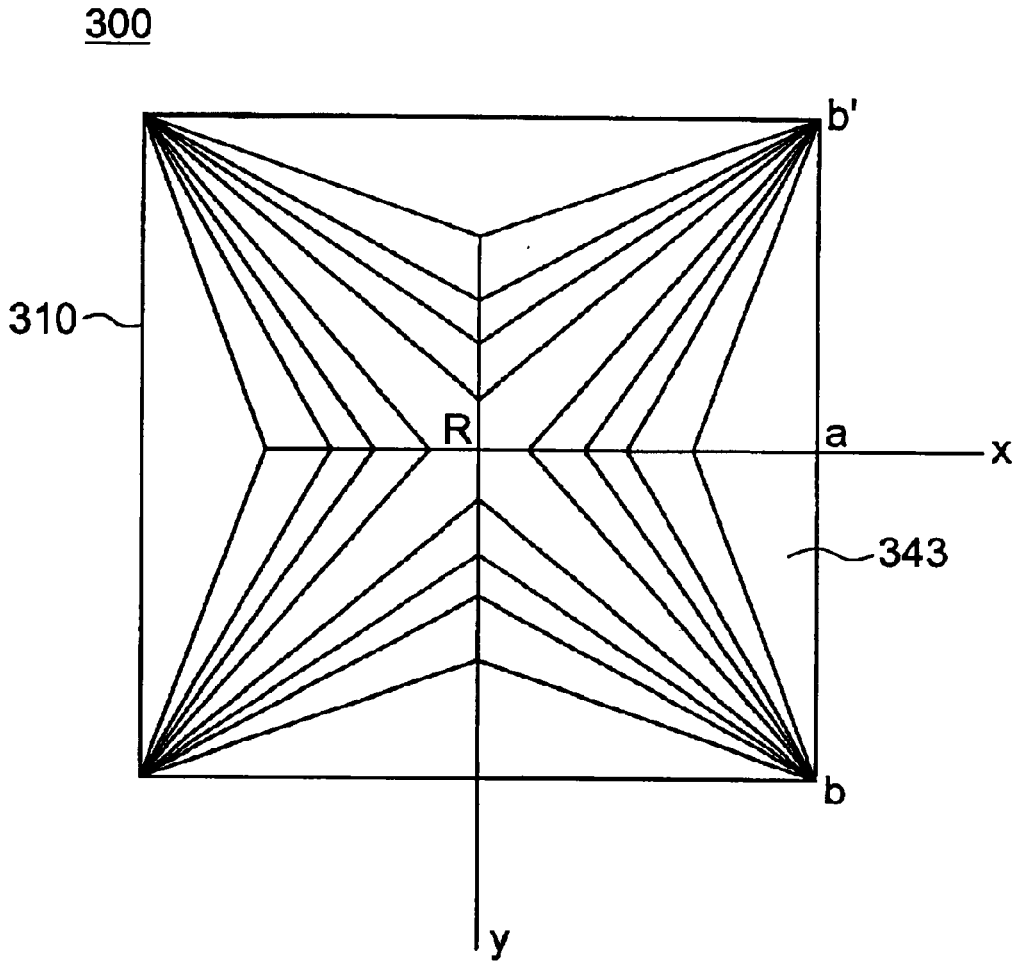
FIG. 14 shows a bottom view of the improved rectangular brilliant-cut diamond of EXAMPLE 3 according to the invention.

FIGS. 8 to 10 show EXAMPLE 2 of a diamond subjected to the improved rectangular brilliant-cut according to the invention, and FIGS. 12 to 14 show EXAMPLE 3 of a diamond subjected to the same cut. FIGS. 8 and 12 are top views, FIGS. 9 and 13 are side views, and FIGS. 10 and 14 are bottom views. As can be seen clearly from a comparison of FIGS. 1, 8 and 12, the crown configurations therein are all the same. As can be seen clearly from a comparison of FIGS. 9 and 10 with FIGS. 2 and 3, in the improved rectangular brilliant-cut 200 of EXAMPLE 2, between a side bL passing through a lower vertex b of the girdle 210 among the sides of a pavilion facet 241 and a side bS of a pavilion girdle facet 244 passing through the same vertex b of the girdle 210 and having an end S on the zx plane, there are two surface boundary lines bM, bN passing through the same vertex b and respectively having ends M, N on the zx plane, and therewith there are three facets 247, 249 and 251 between the two facets 241 and 244.

Figure 11:
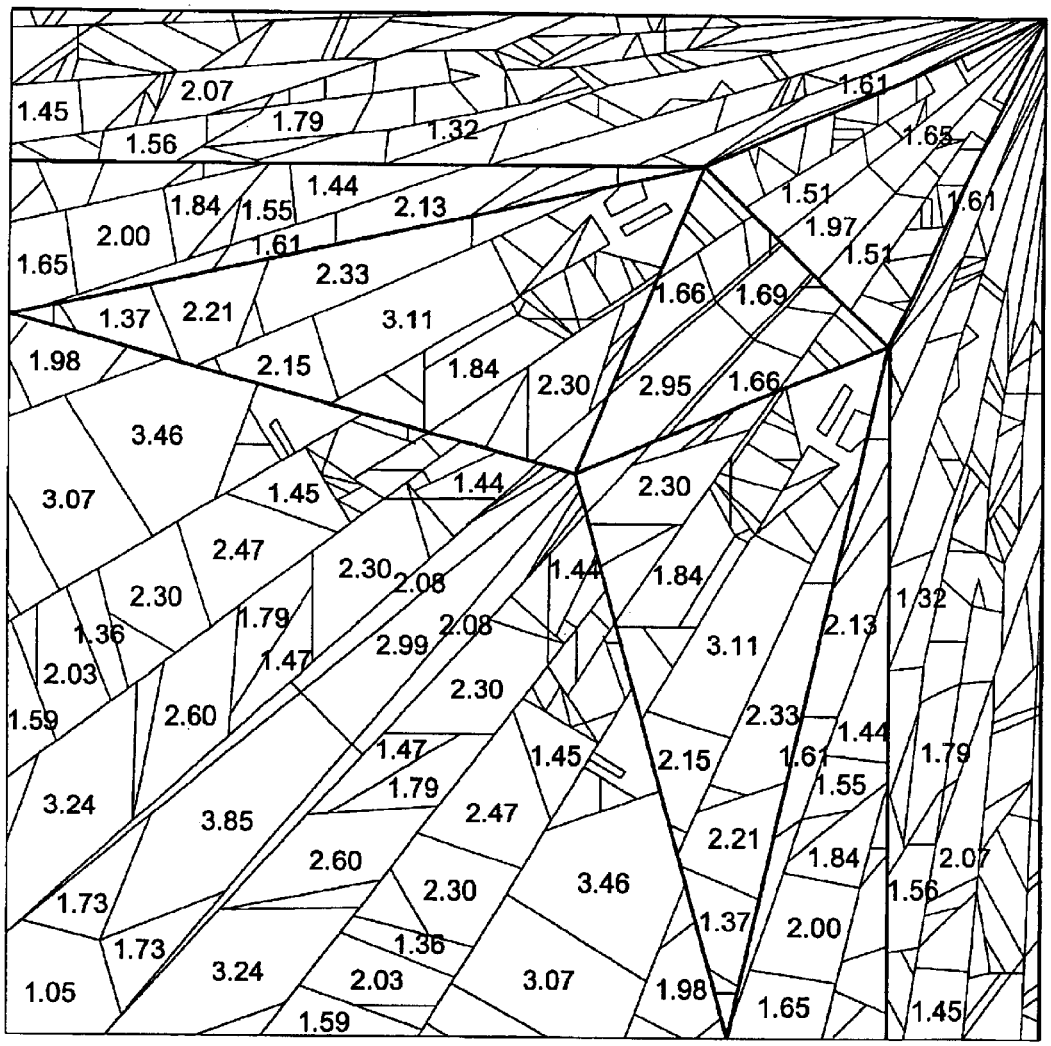
FIG. 11 is a diagram illustrating the first quadrant of the reflection patterns by the improved rectangular brilliant-cut diamond of EXAMPLE 2 according to the invention.
Figure 15:
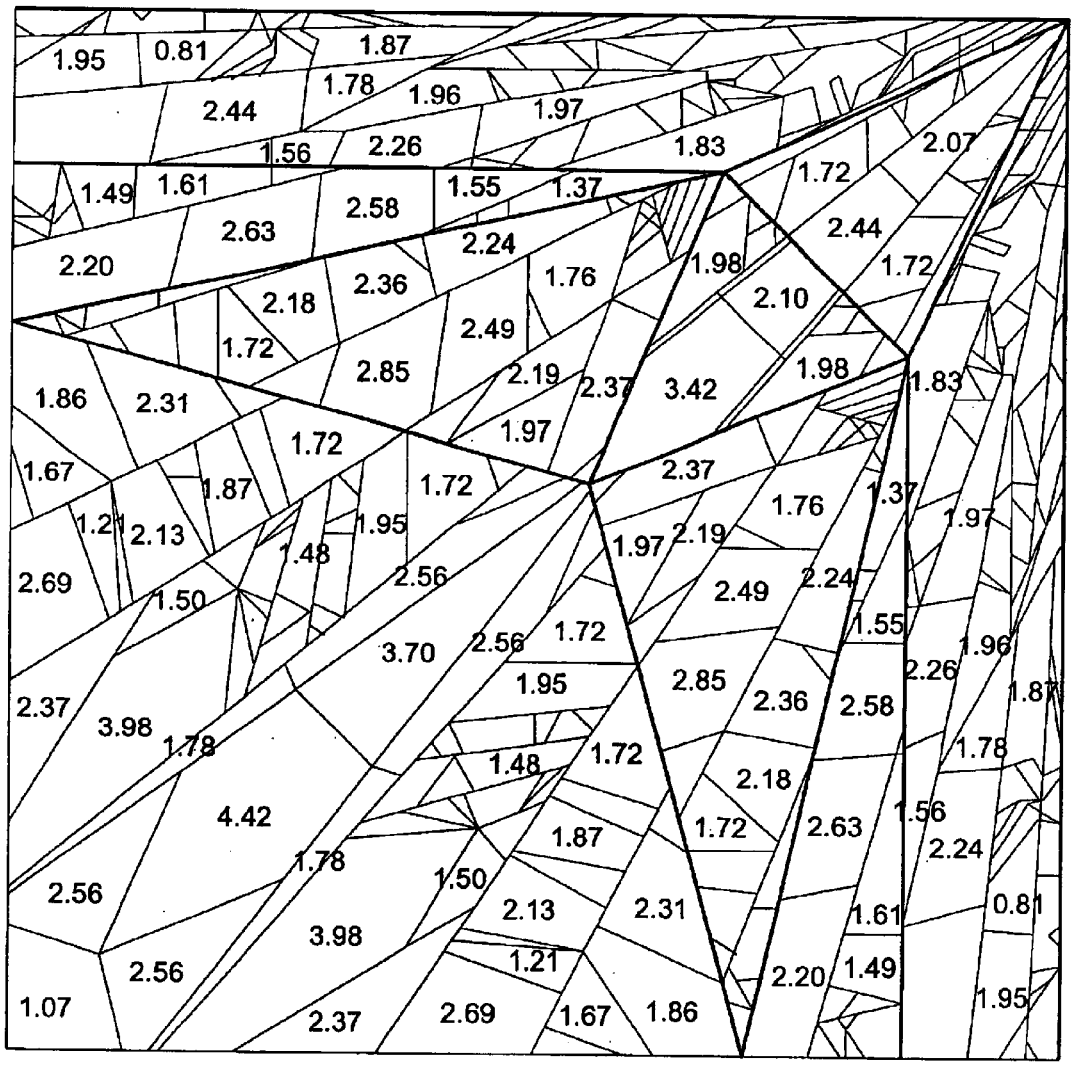
FIG. 15 is a diagram illustrating the first quadrant of the reflection patterns by the improved rectangular brilliant-cut diamond of EXAMPLE 3 according to the invention.

As can be seen clearly from a comparison of FIGS. 13 and 14 with FIGS. 9 and 10, in the improved rectangular brilliant-cut 300 of EXAMPLE 3 shown in FIGS. 13 and 14, a pavilion girdle facet 343 is not bent at the midpoint a of an edge bb' of the girdle 310, while in the improved rectangular brilliant-cut 200 of EXAMPLE 2 shown in FIGS. 9 and 10, a pavilion girdle facet is bent along the side gS passing through the center of a girdle side face, and is divided into two facets 244 and 244'. The first quadrants of the reflection patterns of EXAMPLES 2 and 3 are shown in FIGS. 11 and 15, respectively. Additionally, Table 2 shows the feature values and the visual-perceptible reflection ray amounts of these shapes. The symbols used in Table 2 are the same as those in Table 1. As can be seen clearly from the visual-perceptible reflection ray amounts of EXAMPLES 1 to 3, the increase of the number of pavilion facets by increasing the number of boundary lines dividing the portion between a pavilion facet and an adjacent pavilion girdle facet does not necessarily increase the visual-perceptible reflection ray amount. The smaller is the number of the pavilion facets, the more preferable is the case in view of the smaller number of machining steps. However, as in EXAMPLES 1 and 2, the division of the pavilion girdle facets at the central portions thereof is found to make the reflection patters all alike to each other.

TABLE 2

| | EXAMPLE 2 | EXAMPLE 3 |
|---|---|---|
| SPECIMEN | A417 | A406 |
| CB | 24.0 | 24.0 |
| UCB | 17.5 | 17.5 |
| PB | 39.0 | 39.0 |
| CA | 45.0 | 45.0 |
| F | 1.1 | 1.1 |
| Delx | 1.4 | 1.4 |
| C | 1.7 | 1.7 |
| Lx | 0.2 | 0.3 |
| Mx | 0.5 | 0.7 |
| Nx | 0.8 | 1.0 |
| Sx | 1.2 | 1.4 |
| 20–45 | 397.0 | 437.9 |
| 0–90 w | 445.2 | 598.8 |
| AVERAGE | 421.1 | 518.3 |

In the above descriptions on EXAMPLES 1 to 3, detailed descriptions have been made on the rectangular brilliant-cut with a square, and similar description is also applicable to quadrilateral other than a square, for example a rectangle. In the case where a side is considerably longer than an adjacent side in a rectangle, the number of lines dividing the pavilion portion, adjacent to the longer side, between a pavilion main facet and a pavilion girdle facet can be made larger than the number of lines dividing the adjacent pavilion portion adjacent to a shorter side. It is possible to provide, between a pavilion main facet and a pavilion girdle facet, either five triangular facets in the portion adjacent to the longer side and three triangular facets in the portion adjacent to the shorter side or three to four triangular facets in the portion adjacent to the longer side and two to three triangular facets in the portion adjacent to the shorter side. In such a rectangular brilliant-cut, it is preferable that the angles formed by the four pavilion main facets and the horizontal girdle cross section are made identical to each other.

As has been described in detail, in the improved rectangular brilliant-cut according to the invention, the bezel facets at the four crown vertexes are bent along the diagonal line parallel to the horizontal girdle cross section, and thus each of the bezel facets is divided into the lower bezel facet and the upper bezel facet. Accordingly, the star facets in the crown and the second bezel facets can be made to have small tilt angles from the horizontal and large areas. Herewith, the refection patters of the star facets, second bezel facets and table facet become all alike in size in a manner preferable for visual-perception and the brilliance thereof becomes intense. Making the star facets and the second bezel facets have small tilt angles from the horizontal, in cooperation with enlargement of the areas of the star facets and the second bezel facets, permits obtaining a cut which is imparted with extremely intense reflection (the visual-perceptible reflection ray amount).

What is claimed is:

1. An improved rectangular brilliant-cut diamond comprising a rectangular columnar girdle, a crown having an octagonal table facet on a top of the crown and formed above the girdle and a pavilion below the girdle, wherein the rectangular columnar girdle has an upper rectangular cross section parallel to the table facet at a boundary between the girdle and the crown, the crown comprises four trapezoidal crown girdle facets, four lower triangular bezel facets, four upper triangular bezel facets, four second triangular bezel facets and eight triangular star facets on an outer surrounding surface of the crown, the table facet having four first vertexes and four second vertexes, each of the four first vertexes being located adjacent to each of four vertexes of the upper cross section of the girdle and each of the four second vertexes being at a point displaced in a direction opposite to a line (hereinafter referred to as "center line") vertical to the table facet from a center point between the two neighboring first vertexes, the four crown girdle facets and the four lower bezel facets being aligned alternately to form a row along and above the boundary, the four crown girdle facets each having a base coinciding with a side of the upper cross section of the girdle and the lower bezel facets each having a vertex, two sides passing the vertex and a base opposite to the vertex, the vertex coinciding with each of the vertexes of the upper cross section of the girdle and jointly owned by two crown girdle facets on both sides of each of the lower bezel facets, the two sides each coinciding with a side of each of the two crown girdle facets and the base having two ends each coinciding with a vertex owned by each of the two crown girdle facets, the four upper bezel facets, the four second bezel facets and the eight star facets being aligned to form another row between the table facet and the row having the crown girdle facets and the lower bezel facets, the upper bezel facets each having a vertex coinciding with one of the first vertexes of the table facet and a base coinciding with the base of the lower bezel facets, the lower bezel facets each having an angle with the table facet larger than an angle between each of upper bezel facets and the table facet, and the pavilion comprises four rectangular pavilion main facets and a plurality of triangular pavilion girdle facets on an outer surrounding surface of the pavilion, the pavilion main facets each having two opposite vertexes, one of which is a lower apex of the diamond on the center line and the other of which coincides with each of lower vertexes of the girdle, and two sides each coinciding with a side owned by a neighboring pavilion main facet on a plane (hereinafter referred to as "center dividing plane") passing both the center line and a center between two neighboring lower vertexes of the girdle.

2. An improved rectangular brilliant-cut diamond as set forth in claim 1, wherein the angle between the lower bezel facet and the table facet is 23 to 26 degrees, the angle between the upper bezel facet and the table facet is smaller than the angle between the lower bezel facet and the table facet and 13 to 25 degrees, and the pavilion main facet is at an angle of 38 to 42 degrees with the table facet.

3. An improved rectangular brilliant-cut diamond as set forth in claim 1, wherein the pavilion comprises four triangular pavilion girdle facets, each of which has a base coinciding with a connecting line between the two neighboring lower vertexes of the girdle and a vertex opposite to the base on the center dividing plane crossing the base, one of the pavilion main facets and a pavilion girdle facet adjacent to the pavilion main facet jointly owning a vertex coinciding with one of the lower vertexes of the girdle, the pavilion main facet having a side passing the co-owned vertex and an end on the same center dividing plane, the pavilion girdle facet adjacent to the pavilion main facet having a side passing the co-owned vertex and another end on the same center dividing plane, wherein between the side of the pavilion main facet and the side of the pavilion girdle facet adjacent to the pavilion main facet, the pavilion has at least two triangular facets, owning the co-owned vertex, divided into by at least one neighboring boundary line passing the co-owned vertex and an end on the same center dividing plane.

4. An improved rectangular brilliant-cut diamond as set forth in claim 3, wherein the pavilion has one boundary line passing the co-owned vertex of the girdle and the other end on the same center dividing plane to have two triangular facets, owning the co-owned vertex, divided into by the neighboring boundary line between the side of the pavilion main facet and the side of the pavilion girdle facet adjacent to the pavilion main facet.

5. An improved rectangular brilliant-cut diamond as set forth in claim 3, wherein the angle between the lower bezel facet and the table facet is 23 to 26 degrees, the angle between the upper bezel facet and the table facet is smaller than the angle between the lower bezel facet and the table facet and 13 to 25 degrees, and the pavilion main facet is at an angle of 38 to 42 degrees with the table facet.

6. An improved rectangular brilliant-cut diamond as set forth in claim 3, wherein, assuming that the center line stands at the origin (0, 0) of x, y-coordinates and that one of the girdle lower vertexes is at (2, 2) of the x, y-coordinates, the first vertex, adjacent to the girdle lower vertex, of the table facet is at (0.7 to 1.2, 0.7 to 1.2) of the x, y-coordinates, the three lines closest to the center line among the side of the pavilion main facet, the side of the pavilion girdle facet, and the boundary lines between the side of the pavilion main facet and the side of the pavilion girdle facet adjacent to the pavilion main facet cross the center dividing plane at points closer to the origin than x-coordinate of the first vertex of the table facet, and the second vertex of the table facet is at x-coordinate of 1.3 to 1.6.

7. An improved rectangular brilliant-cut diamond as set forth in claim 1, wherein the pavilion comprises eight triangular pavilion girdle facets, each of which has a vertex on a crossing line between a girdle side facet and a center dividing plane crossing the girdle side facet, another vertex coinciding with a lower vertex of the girdle side facet, and a separated vertex on the center dividing plane, each of the pavilion girdle facets having a side co-owned on the center dividing plane with a neighboring pavilion girdle facet that has a vertex coinciding with another lower vertex of the same girdle side facet, the two neighboring pavilion girdle facets having such an angle therebetween that the co-owned side on the center dividing plane forms a ridge therebetween, one of the pavilion main facets and a pavilion girdle facet adjacent to the pavilion main facet jointly owning a vertex coinciding with one of the lower vertexes of the girdle, the pavilion main facet having a side passing the co-owned vertex and an end on the same center dividing plane, the pavilion girdle facet adjacent to the pavilion main facet having a side passing the co-owned vertex and another end on the same center dividing plane, wherein between the side of the pavilion main facet and the side of the pavilion girdle facet adjacent to the pavilion main facet, the pavilion has at least two triangular facets, owning the co-owned vertex, divided into by at least one neighboring boundary line passing the co-owned vertex and further another end on the same center dividing plane.

8. An improved rectangular brilliant-cut diamond as set forth in claim 7, wherein the pavilion has one boundary line passing the co-owned vertex of the girdle and the other end on the same center dividing plane to have two triangular facets, owning the co-owned vertex, divided into by the neighboring boundary line between the side of the pavilion main facet and the side of the pavilion girdle facet adjacent to the pavilion main facet.

9. An improved rectangular brilliant-cut diamond as set forth in claim 7, wherein the angle between the lower bezel facet and the table facet is 23 to 26 degrees, the angle between the upper bezel facet and the table facet is smaller than the angle between the lower bezel facet and the table facet and 13 to 25 degrees, and the pavilion main facet is at an angle of 38 to 42 degrees with the table facet.

10. An improved rectangular brilliant-cut diamond as set forth in claim 7, wherein, assuming that the center line stands at the origin (0, 0) of x, y-coordinates and that one of the girdle lower vertexes is at (2, 2) of the x, y-coordinates, the first vertex, adjacent to the girdle lower vertex, of the table facet is at (0.7 to 1.2, 0.7 to 1.2) of the x, y-coordinates, the three lines closest to the center line among the side of the pavilion main facet, the side of the pavilion girdle facet, and the boundary lines between the side of the pavilion main facet and the side of the pavilion girdle facet adjacent to the pavilion main facet cross the center dividing plane at points closer to the origin than x-coordinate of the first vertex of the table facet, and the second vertex of the table facet is at x-coordinate of 1.3 to 1.6.

* * * * *